US011017965B1

(12) United States Patent
Soberanis et al.

(10) Patent No.: US 11,017,965 B1
(45) Date of Patent: May 25, 2021

(54) PUSHBUTTON ASSEMBLY

(71) Applicant: BCS AUTOMOTIVE INTERFACE SOLUTIONS US LLC, Wilmington, DE (US)

(72) Inventors: Oscar Sanchez Soberanis, Novi, MI (US); Xujie Yang, Novi, MI (US); Amara Lingeswara Prasad Vasam, Novi, MI (US)

(73) Assignee: BCS AUTOMOTIVE INTERFACE SOLUTIONS US LLC, Wilmington, DE (US)

( * ) Notice: Subject to any disclaimer, the term of this patent is extended or adjusted under 35 U.S.C. 154(b) by 0 days.

(21) Appl. No.: 16/859,179

(22) Filed: Apr. 27, 2020

(51) Int. Cl.

| | |
|---|---|
| ***H01H 13/14*** | (2006.01) |
| ***H01H 1/24*** | (2006.01) |
| ***H01H 13/78*** | (2006.01) |
| ***H01H 15/00*** | (2006.01) |
| ***H01H 13/705*** | (2006.01) |

(52) U.S. Cl.
CPC ..... *H01H 13/14* (2013.01); *H01H 1/24* (2013.01); *H01H 13/705* (2013.01); *H01H 13/78* (2013.01); *H01H 15/00* (2013.01); *H01H 2231/00* (2013.01)

(58) Field of Classification Search
CPC ..... H01H 13/14; H01H 1/24; H01H 13/705; H01H 13/78; H01H 3/12; H01H 2221/058
USPC .... 200/179, 8 R, 6 A, 4, 5 R, 17 R, 18, 341, 200/344, 345; 345/156–169, 173
See application file for complete search history.

(56) References Cited

U.S. PATENT DOCUMENTS

| | | | | |
|---|---|---|---|---|
| 5,817,997 | A * | 10/1998 | Wernig | H01H 13/14 200/16 R |
| 9,170,658 | B2 | 10/2015 | Quek | |
| 2016/0071662 | A1* | 3/2016 | Cai | H01H 13/14 200/314 |

* cited by examiner

*Primary Examiner* — Edwin A. Leon
*Assistant Examiner* — Iman Malakooti
(74) *Attorney, Agent, or Firm* — Tarolli, Sundheim, Covell & Tummino LLP

(57) ABSTRACT

A pushbutton assembly comprises a base, a pushbutton which is displaceable in a push direction relative to the base from an unactuated rest position into an actuated position and vice versa, and a return device which biases the pushbutton towards the rest position. Further, a self-centering device is provided which comprises a button part and a base part, the button part and the base part of the self-centering device cooperating in the rest position of the pushbutton so as to position the pushbutton in a centered position with respect to the base.

12 Claims, 3 Drawing Sheets

PUSHBUTTON ASSEMBLY

TECHNICAL FIELD

The invention relates to a pushbutton assembly.

BACKGROUND OF THE INVENTION

They usually comprise a base, a pushbutton which is displaceable relative to the base from an unactuated rest position into an actuated position and vice versa, and a return device which biases the pushbutton towards the rest position.

Due to fabrication tolerances, pushbuttons usually do not return to a defined position after being actuated. This results in pushbuttons that are off-center or displaced in the rest position which has an impact on the aesthetic of devices comprising such a pushbutton assembly and may decrease the functionality of the pushbutton.

The object of the invention is to provide a pushbutton assembly with at least one pushbutton which reliably returns into a defined position after being actuated.

BRIEF DESCRIPTION OF THE INVENTION

In order to achieve this object, the invention provides a pushbutton assembly with a base, a pushbutton which is displaceable in a push direction relative to the base from an unactuated rest position into an actuated position and vice versa, and a return device which biases the pushbutton towards the rest position. The pushbutton assembly further comprises a self-centering device which has a button part and a base part. The button part and the base part of the self-centering device cooperate in the rest position of the pushbutton so as to position the pushbutton in a centered position with respect to the base. In this way, the self-centering device ensures that the pushbutton reliably returns to a defined and centered position after being actuated. Thus, the pushbutton always has the same distance to its surroundings in the rest position.

In particular, the self-centering device centers the pushbutton relative to a central axis which runs in the push direction through the base.

The pushbutton may be mounted relative to the base with a clearance in at least one direction perpendicular to the push direction, in particular in a centering direction of the self-centering device. In the meaning of the invention, the centering direction of the self-centering device is a direction the pushbutton is forced in by the self-centering device when the pushbutton has an off-centered position and the button part and the base part are engaged. This embodiment has the advantage that the pushbutton assembly can be manufactured with fabrication tolerances which reduce rejects while the self-centering device guarantees a defined position of the pushbutton in the rest position.

According to one aspect of the invention, the button part comprises a button guiding contour and the base part comprises a base guiding contour. In the rest position, the button part and the base part are engaged with each other and the button guiding contour contacts the base guiding contour. The button guiding contour and the base guiding contour are shaped in a way that force the pushbutton in a centering direction when the pushbutton has an off-centered position and returns to the rest position. By providing corresponding guiding contours, a highly reliable self-centering of the pushbutton assembly can be ensured. Also, the shape of the guiding contours controls how the pushbutton returns to its defined position in the rest position.

In particular, the button guiding contour and the base guiding contour are shaped in a way that the button part always comes to rest against the base part in a single defined position in the rest position of the pushbutton assembly. The single defined position corresponds to the centered position of the pushbutton.

According to one embodiment of the invention, the button guiding contour is converging in the push direction and/or the base guiding contour is converging in the push direction. Alternatively, the button guiding contour is diverging in the push direction and/or the base guiding contour is diverging in the push direction. Guiding contours diverging from or converging to a point that defines the centered position of the pushbutton, are very effective shapes for guiding contours, especially if both the button guiding contour and the base guiding contour are shaped that way.

Preferably, the button guiding contour and the base guiding contour have a complementary shape which ensures effective guiding in all positions the button guiding contour and the base guiding contour are engaged in.

According to another aspect of the invention, the button part and the base part are disengaged in the actuated position. In addition or in the alternative, there is no contact between the button guiding contour and the base guiding contour in the actuated position. In this way, the button part and the base part are separated when the pushbutton is pushed into the actuated position which reduces the interaction of the button part and the base part, like friction, and thus improves the operability and ease of use of the pushbutton assembly.

According to a further embodiment of the invention, the base part forms a stop for the pushbutton in the rest position. By combining multiple functionalities in the base part, the pushbutton assembly can be designed more compact and/or less complex.

In another embodiment of the invention, the pushbutton assembly comprises a snap connection by means of which the pushbutton is attached to the base. The button part and/or the base part form part of the snap connection. The snap connection allows for easy and secure assembly, while the integration of the button part and/or the base part into the snap connection allows for a reduced number of manufacturing steps.

According to another aspect of the invention, the self-centering device comprises at least one insertion chamfer for mounting the pushbutton to the base. In addition or in the alternative, the button part and/or the base part are part of a flexible section of the pushbutton or base respectively. In this way, the pushbutton assembly can be assembled more easily and with reduced risk of damaging the pushbutton assembly.

The pushbutton may be slidably guided in the push direction by the base to stabilize the pushbutton and thus improve the haptic of the pushbutton assembly.

The pushbutton assembly can have at least two self-centering devices for centering the pushbutton relative to the base to provide a more robust and reliable self-centering functionality.

According to one aspect of the invention, two self-centering devices are provided on the same side of the base. In addition or in the alternative, two self-centering devices can be provided on opposite sides of the base. In this way, the self-centering functionality can be improved.

According to another aspect of the invention, the centering directions of two self-centering devices are perpendicular to each other to reliably center the pushbutton in two dimensions.

Any individual feature of any of the embodiments disclosed above may be part of any of the embodiments disclosed above thus forming a further embodiment of the invention. In other words, any or all of the individual features disclosed above can be combined in a further embodiment of the invention.

BRIEF DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

DETAILED DESCRIPTION OF THE INVENTION

Figure 1:
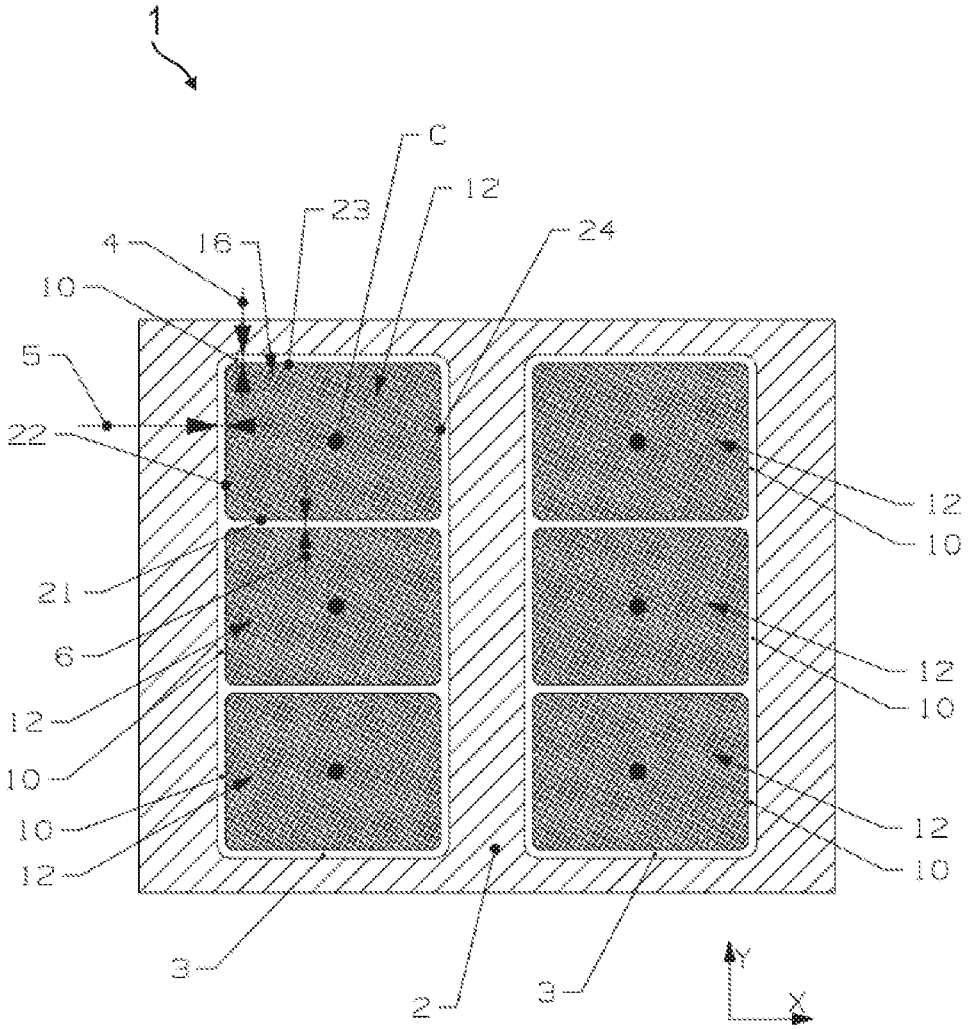
FIG. 1 schematically shows a device with multiple pushbutton assemblies according to the invention.

FIG. 1 schematically shows a device 1 comprising a panel 2 with two recesses 3, and six pushbutton assemblies 10 arranged in two rows of three in the recesses 3.

Generally, the device 1 can be of any design and comprise any number of pushbutton assemblies 10 in any kind of layout.

According to one embodiment, the device 1 has a cover, bezel or panel 2 in which at least one pushbutton assembly 10 is housed. The cover, bezel or panel 2 is provided for aesthetic purposes rather than for mechanical purposes.

Figure 2:
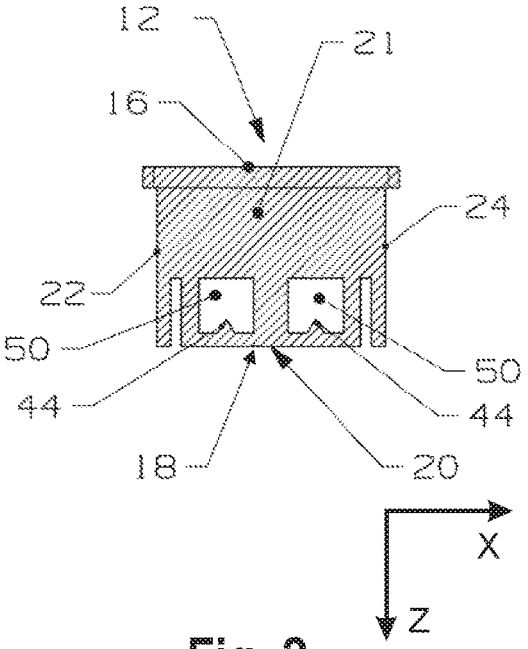
FIG. 2 schematically shows a pushbutton of one of the pushbutton assemblies of FIG. 1 according to a first embodiment.
Figure 3:
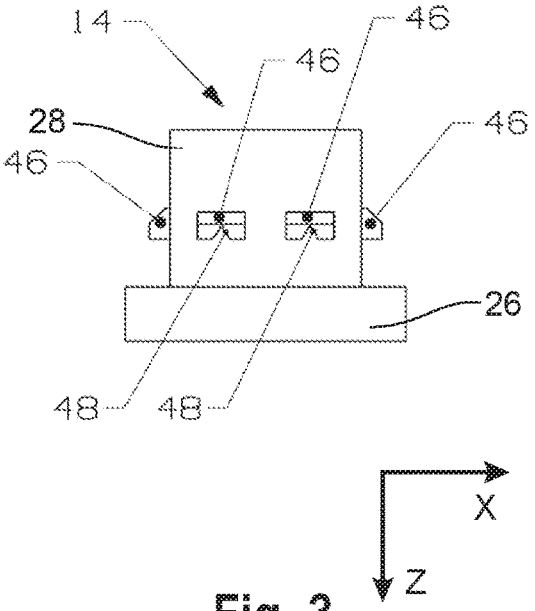
FIG. 3 schematically shows a base of one of the pushbutton assemblies of FIG. 1 according to the first embodiment.

In the embodiment shown in FIG. 1, each pushbutton assembly 10 is of identical design and construction. Therefore, in the following the structure and functionality of the pushbutton assemblies 10 will be described by example of a single pushbutton assembly 10 by reference to FIGS. 2 to 4.

Of course, in a further embodiment multiple pushbutton assemblies 10 with different designs and constructions can be used in a single device 1.

Pushbutton assembly 10 comprises a pushbutton 12 and a base 14.

The pushbutton 12 is generally cuboidal with a rectangular top 16 (see FIG. 1) which forms the side for a user to push the pushbutton 12, an inner socket 18 which opens into the bottom 20 of the pushbutton 12 as well as four sidewalls 21, 22, 23, 24 which enclose the socket 18 on its sides.

Sidewall 21 and sidewall 23 as well as sidewall 22 and sidewall 24 respectively are arranged opposite to each other.

In an alternative embodiment, the pushbutton 12 can comprise any number of sidewalls 21, 22, 23, 24, in particular two sidewalls 21, 22, 23, 24 which are arranged opposite to each other.

Generally, the pushbutton 12 can have any shape. In particular, the pushbutton 12 can be generally cylindrical or prism shaped, especially with a circular or triangular base.

The base 14 has a basis 26 and a stem 28 connected to the basis 26.

Figure 4:
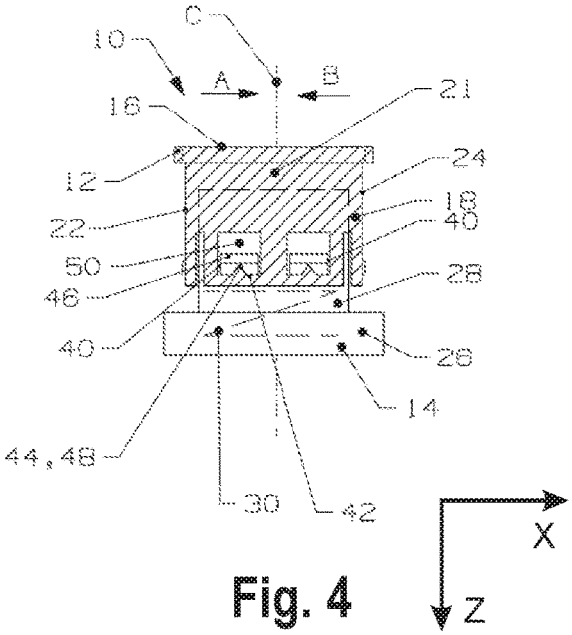
FIG. 4 schematically shows the first embodiment of one of the pushbutton assemblies of FIG. 1 in a rest position.
Figure 5:
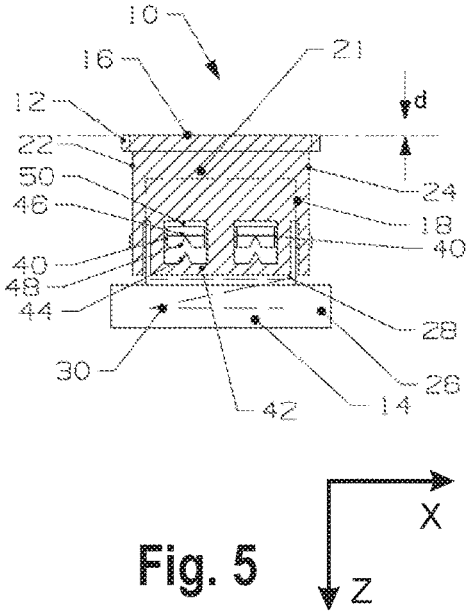
FIG. 5 schematically shows the pushbutton assembly of FIG. 4 in an actuated position.

The pushbutton 12 is slidably mounted in the Z-direction to the base 14 with the stem 28 extending into the socket 18 (see FIGS. 4 and 5).

The pushbutton assembly 10 has an unactuated rest position, shown in FIG. 4, and an actuated position, shown in FIG. 5, which refers to the position the pushbutton 12 is pushed into by a user to trigger a signal and which differs from the rest position in that the relative position between the pushbutton 12 and the base 14 differs by a distance d in the Z-direction.

The Z-direction, the pushbutton 12 is pushed in to switch the pushbutton assembly 10 into the actuated position, defines the push direction of the pushbutton assembly 10.

In order to bias the pushbutton assembly 10 into the rest position, the pushbutton assembly 10 comprises a return device 30 in the form of a spring element which is arranged in operative connection between the pushbutton 12 and the base 14 and preloads the pushbutton 12 against push direction Z away from the base 14.

In another embodiment, the return device 30 can be any kind of device suitable to bias the pushbutton assembly 10 into the rest position.

The socket 18 and the stem 28 have a complementary cross-section in the X-Y-plane such that the stem 28 forms a guiding member for the pushbutton 12 in the push direction.

Further, there is a small clearance in the X-direction as well as in the Y-direction between the stem 28 and the pushbutton 12, especially between the stem 28 and the sidewalls 21, 22, 23, 24.

In order to keep the pushbutton 12 centered relative to the central axis C (see FIGS. 1 and 4) of the base 14, the pushbutton assembly 10 comprises eight self-centering devices 40, two on each side 21, 22, 23, 24.

In an alternative embodiment, the pushbutton assembly 10 can comprise any number of self-centering devices 40 arranged on any sides. In view of mechanical stability, it is preferred that at least one self-centering device 40 is arranged on each of the sides.

Each self-centering device 40 comprises a button part 42 with a button guiding contour 44 and a corresponding base part 46 with a base guiding contour 48.

In the following the structure and functionality of the self-centering devices 40 will be described by example of a single self-centering device 40.

The button part 42 is formed by a section of the sidewall 21 with a slit-like opening 50 which extends away from the button guiding contour 44 against push direction Z.

The base part 46 is formed by a protrusion of the stem 28 extending in the Y-direction into the opening 50 of the corresponding button part 42.

The base guiding contour 48 is located opposite the button guiding contour 44 in the push direction Z.

The base part 46 is slidably arranged within the opening 50 in the push direction Z and with a clearance in the X-direction.

The button guiding contour 44 has a V-shaped profile in the X-Z-plane. The tip of the "V" pointing against the push direction Z toward the base part 46.

The base guiding contour 48 has a complementary shape to the button guiding contour 44 with a V-shaped profile in the X-Z-plane. The tip of the "V" pointing against the push direction Z away from the button part 42. Thus, the base guiding contour 48 has a complementary shape to the button guiding contour 44.

The self-centering device 40 is designed such that in the rest position (see FIG. 4) the button part 42 and the base part 46 are engaged to each other via the button guiding contour 44 and the base guiding contour 48 in a centered position in which the pushbutton 12 is centered in the X-direction relative to the base 14.

Further, the self-centering device 40 is designed such that when the pushbutton 12 is pushed in the push direction Z the button part 42 and the base part 46 disengage and the pushbutton 12 is free in the X-direction due to the clearance between the pushbutton 12 and the base 14.

In the actuated position (see FIG. 5) the button guiding contour 44 and the base guiding contour 48 do not contact each other.

The basis 26 forms a stop for the pushbutton 12 in the actuated position.

When the pushbutton 12 is released from the actuated position, the return device 30 pushes the pushbutton 12 against push direction Z into the rest position. On the way back to the rest position, the button guiding contour 44 and the base guiding contour 48 get in contact with each other and align the button part 42 and the base part 46 in the centered position.

The button guiding contour 44 and the base guiding contour 48 are shaped in such a way that the pushbutton 12 is pulled in center direction A or center direction B when the pushbutton 12 is off-center to the left or right, respectively, of the central axis C (from the perspective shown in FIG. 4).

The base part 46 forms a stop for the pushbutton 12 in the rest position.

While the self-centering devices 40 located on sides 21, 23 extending in the X-Z-plane center the pushbutton 12 in the X-direction relative to the base 14, the self-centering devices 40 located on sides 22, 24 extending in the Y-Z-plane center the pushbutton 12 in the Y-direction relative to the base 14.

In this way, the pushbutton 12 reliably returns to a centered position relative to the central axis C.

Thus, any gaps 4, 5 (see FIG. 1) between a pushbutton 12 and the panel 2 as well as any gaps 6 between neighboring pushbuttons 12 are well-defined.

Generally, the button guiding contour 44 and the base guiding contour 48 each can be shaped in various ways, as long as they provide the above described self-centering functionality.

In another embodiment, the button guiding contour 44 and the base guiding contour 48 can be shaped in a way that a single self-centering device 40 provides centering functionality in both the X- and the Y-direction. In particular, at least one of the button guiding contour 44 or the base guiding contour 48 is sloped in the X- and the Y-direction toward a common center point in the Z-direction, for example like a trough or a three dimensional arrow head.

Thus, a pushbutton assembly 10 with a single self-centering device 40 designed in this way can reliably ensure a center position of the pushbutton 12.

In order to facilitate mounting the pushbutton 12 to the base 14, the pushbutton 12 is resilient and elastic so that the sidewalls 21, 22, 23, 24 yield when the pushbutton 12 is pushed on top of the base 14 in the push direction Z.

In addition or in the alternative, the base part 46 can itself can be flexible and/or the base part 46 can be part of a flexible section of the base 14.

Figure 6:
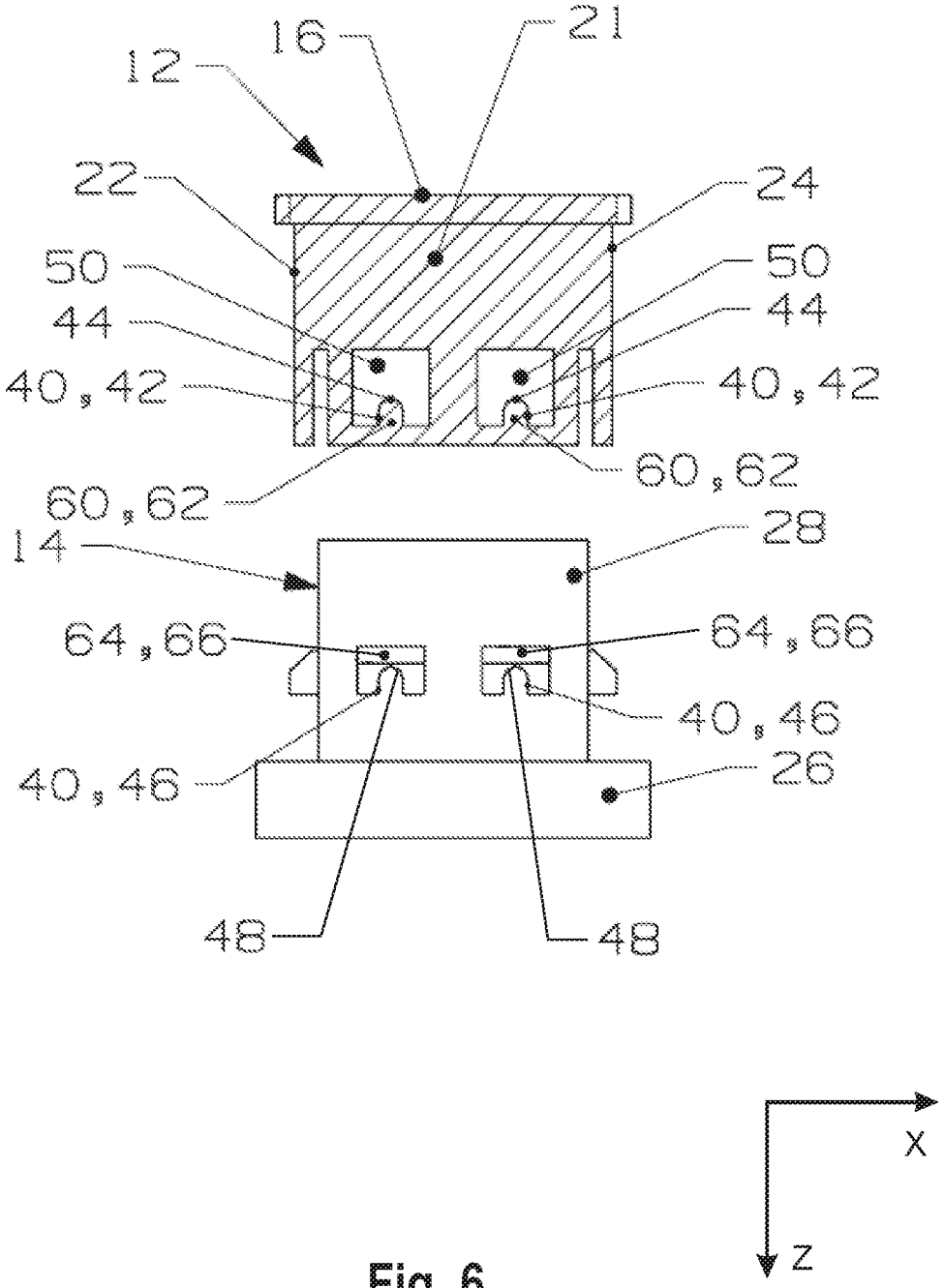
FIG. 6 schematically shows a second embodiment of one of the pushbutton assemblies of FIG. 1 in an exploded view.

FIG. 6 shows a pushbutton 12 and a base 14 of a pushbutton assembly 10 with a self-centering device 40 according to a second embodiment.

In this embodiment, the button part 42 and the base part 46 form part of a snap connection 60 by means of which the pushbutton 12 is attached to the base 14.

The button part 42 comprises a flexible latch 62 extending against the push direction Z into opening 50 as well in the Y-direction towards the stem 26.

The button guiding contour 44 is formed by the end of the latch 62 protruding into the opening 50.

The base part 46 is horseshoe shaped with a bend 64 and opens in the push direction Z.

The button guiding contour 44 and the base guiding contour 48 each have a semicircle shaped profile in the X-Z-plane which are complementary to each other.

The base guiding contour 48 is formed by the bend 64.

Further, the bend 64 comprises an insertion chamfer 66 which flattens away from the basis 26 against push direction Z.

When the pushbutton 12 is pushed in the push direction Z on top of the stem 28 for mounting the pushbutton 12 to the base 14, the latch 62 slides over the insertion chamfer 66 and snaps into the center of the horseshoe shaped base part 46 which results in a secure connection.

In addition or in the alternative, the base part 46 can be designed as part of a flexible latch via which the base part 46 is connected to the stem 28.

The invention claimed is:

1. A pushbutton assembly with a base, a pushbutton which is displaceable in a push direction relative to the base from an unactuated rest position into an actuated position and vice versa, and a return device which biases the pushbutton towards the rest position, a self-centering device being provided which comprises a button part and a base part, the button part and the base part of the self-centering device cooperating in the rest position of the pushbutton so as to position the pushbutton in a centered position with respect to the base, the self-centering device comprising at least one insertion chamfer for mounting the pushbutton to the base, and/or the button part and/or the base part are part of a flexible section of the pushbutton or base respectively.

2. The pushbutton assembly of claim 1 wherein the pushbutton is mounted relative to the base with a clearance in at least one direction perpendicular to the push direction.

3. The pushbutton assembly of claim 1 wherein the button part comprises a button guiding contour and the base part comprises a base guiding contour, wherein in the rest position the button part and the base part are engaged with each other and the button guiding contour contacts the base guiding contour.

4. The pushbutton assembly of claim 3 wherein the button guiding contour is converging in the push direction and/or the base guiding contour is converging in the push direction, or wherein the button guiding contour is diverging in the push direction and/or the base guiding contour is diverging in the push direction.

5. The pushbutton assembly of claim 3 wherein the button guiding contour and the base guiding contour have a complementary shape.

6. A pushbutton assembly with a base, a pushbutton which is displaceable in a push direction relative to the base from an unactuated rest position into an actuated position and vice versa, and a return device which biases the pushbutton towards the rest position, a self-centering device being provided which comprises a button part and a base part, the button part and the base part of the self-centering device cooperating in the rest position of the pushbutton so as to position the pushbutton in a centered position with respect to the base, wherein in the actuated position the button part and the base part are disengaged and/or there is no contact between the button guiding contour and the base guiding contour.

7. The pushbutton assembly of claim 1 wherein the base part forms a stop for the pushbutton.

8. The pushbutton assembly of claim 1 wherein the pushbutton assembly comprises a snap connection by means of which the pushbutton is attached to the base, wherein the button part and/or the base part form part of the snap connection.

9. The pushbutton assembly of claim 1 wherein the pushbutton is slidably guided in the push direction by the base.

10. The pushbutton assembly of claim 1 wherein the pushbutton assembly has at least two self-centering devices for centering the pushbutton relative to the base.

11. The pushbutton assembly of claim 10 wherein two self-centering devices are provided on the same side of the base and/or two self-centering devices are provided on opposite sides of the base.

12. The pushbutton assembly of claim 10 wherein the centering directions of two self-centering devices are perpendicular to each other.

* * * * *